US012115570B2

(12) United States Patent
Froböse et al.

(10) Patent No.: US 12,115,570 B2
(45) Date of Patent: Oct. 15, 2024

(54) METHOD AND DEVICE FOR PRODUCING A ROD-SHAPED ELEMENT

(71) Applicant: Alleima GmbH, Werther (DE)

(72) Inventors: Tomas Froböse, Düsseldorf (DE); Christofer Hedvall, Bielefeld (DE)

(73) Assignee: Alleima GmbH, Werther (DE)

( * ) Notice: Subject to any disclaimer, the term of this patent is extended or adjusted under 35 U.S.C. 154(b) by 187 days.

(21) Appl. No.: 17/425,963

(22) PCT Filed: Jan. 30, 2020

(86) PCT No.: PCT/EP2020/052339
§ 371 (c)(1),
(2) Date: Dec. 21, 2021

(87) PCT Pub. No.: WO2020/157226
PCT Pub. Date: Aug. 6, 2020

(65) Prior Publication Data

US 2022/0118494 A1 Apr. 21, 2022

(30) Foreign Application Priority Data

Feb. 1, 2019 (DE) ..... 10 2019 102 600.8

(51) Int. Cl.
*B21C 1/22* (2006.01)
*B21C 37/04* (2006.01)
*B21C 37/08* (2006.01)

(52) U.S. Cl.
CPC ..... *B21C 1/22* (2013.01); *B21C 37/045* (2013.01); *B21C 37/08* (2013.01)

(58) Field of Classification Search
CPC .. B21D 5/10; B21D 5/12; B21D 39/02; B21C 37/042; B21C 37/08; B21C 37/09;
(Continued)

(56) References Cited

U.S. PATENT DOCUMENTS 3,683,471 A * 8/1972 Lemelson ..... B21C 35/02 425/327
4,796,797 A * 1/1989 Nakako ..... B21C 37/08 228/144

(Continued)

FOREIGN PATENT DOCUMENTS

CN 103525976 A 1/2014
CN 104384212 A * 3/2015 ..... B21C 1/00

(Continued)

OTHER PUBLICATIONS

International Search Report (with partial translation) and Written Opinion dated May 12, 2020, issued in corresponding International Patent application No. PCT/EP2020/052339.

(Continued)

*Primary Examiner* — Christopher L Templeton
*Assistant Examiner* — P Derek Pressley
(74) *Attorney, Agent, or Firm* — Morgan, Lewis & Bockius LLP

(57) ABSTRACT

The present disclosure relates to a method for producing a rod-shaped element. In order to provide a method with which it is possible to produce a rod-shaped element which overcomes at least one of the disadvantages of the rod-shaped elements known from the state of the art, it is proposed according to the invention that the method has the steps of providing a tube made of a metal, wherein the tube has a longitudinal direction, providing at least one strand with a plurality of threads, wherein at least one of the threads has carbon fibres, introducing the at least one strand into the tube, with the result that the at least one strand extends in the longitudinal direction in the tube, and cold forming the tube, together with the at least one strand, using a forming tool, with the result that an outside diameter of the tube before the (Continued)

cold forming is larger than the outside diameter of the tube after the cold forming.

18 Claims, 3 Drawing Sheets

(58) Field of Classification Search
CPC ..... B21C 37/102; B21C 37/154; B21C 1/22; B21C 31/00; B21C 23/22–30
USPC ..... 72/258
See application file for complete search history.

(56) References Cited

U.S. PATENT DOCUMENTS

| | | | |
|---|---|---|---|
| 4,906,609 | A | 3/1990 | Yamauchi et al. |
| 6,497,029 | B1 | 12/2002 | Quick et al. |
| 10,501,820 | B2 | 12/2019 | Frobose et al. |
| 2018/0078742 | A1 | 3/2018 | Butler et al. |

FOREIGN PATENT DOCUMENTS

| | | | |
|---|---|---|---|
| CN | 104517684 | A | 4/2015 |
| CN | 107406902 | A | 11/2017 |
| CN | 108728608 | A | 11/2018 |
| DE | 3304881 | A1 | 8/1983 |
| DE | 10 2006 029385 | A1 | 1/2008 |
| DE | 10 2015 102255 | A1 | 8/2016 |
| JP | S61-007506 | A | 1/1986 |
| JP | S61-169114 | A | 7/1986 |
| JP | H01-211813 | A | 8/1989 |
| JP | H101-192437 | A | 8/1989 |
| JP | 2003-290814 | A | 10/2003 |
| JP | 2007-152398 | A | 6/2007 |
| JP | 2014-037639 | A | 2/2014 |
| JP | 2017-201090 | A | 11/2017 |
| KR | 10-1051469 | B1 * | 7/2011 |

OTHER PUBLICATIONS

"Titanium", edited by Wei Mo, Metallurgical Industry Press, pp. 591-592, Jun. 30, 2008.

Office Action dated Feb. 15, 2023, issued in corresponding Chinese Patent Application No. 202080011875.5.

Office Action dated Jul. 27, 2023, issued in corresponding Japanese Patent Application No. 2021-544722.

* cited by examiner

METHOD AND DEVICE FOR PRODUCING A ROD-SHAPED ELEMENT

TECHNICAL FIELD

The present disclosure relates to a method and a device for producing a rod-shaped element, as well as such a rod-shaped element.

TECHNOLOGICAL BACKGROUND

Methods and devices for producing solid rod-shaped elements made of metal, for example metal bars or metal rods, are known from the state of the art. For this, a prefabricated solid cylindrical billet is formed, i.e. in particular rolled or drawn, into a solid rod-shaped element made of metal.

Rod-shaped elements produced in this way are used, for example, to provide, strengthen and reinforce structures. In order to make it possible to absorb high tensile loads, the diameter of the respective rod-shaped element is adapted to the tensile load to be absorbed. However, an enlargement of the diameter is accompanied by an increase in the self-weight of the rod-shaped element. For this reason, limits are set on the use of such rod-shaped elements, in particular for strengthening and reinforcing structures.

SUMMARY

There is therefore a need for a rod-shaped element as well as for a method and a device for producing it, which overcome at least one of the above-named disadvantages. Furthermore, there is a need for a rod-shaped element with a high tensile strength and at the same time a low self-weight.

According to a first aspect of the present disclosure, a method for producing a rod-shaped element is therefore proposed, wherein the method has the steps of:

- providing a tube made of a metal, wherein the tube has an outside diameter and a longitudinal direction,
- providing at least one strand with a plurality of threads, wherein at least one of the threads has carbon fibres,
- introducing the at least one strand into the tube, with the result that the at least one strand extends in the longitudinal direction in the tube, and
- cold forming the tube with the at least one strand introduced therein using a forming tool, with the result that the outside diameter of the tube before the cold forming is larger than the outside diameter of the tube after the cold forming.

The idea on which this method is based is to provide a structure, i.e. a rod-shaped element, with high tensile strength by introducing the at least one strand into a tube made of a metal. In other words, the at least one strand forms the core of the rod-shaped element, wherein the tube extends around the core like a sheath.

Due to the lower material density of carbon fibres compared with metals, with a comparable tensile strength the self-weight of the rod-shaped element is reduced compared with a solid rod-shaped element made of metal with the same outside diameter.

Moreover, the tube forming the sheath of the arrangement provides the advantage that it protects the core inside, i.e. the at least one strand, from environmental influences, for example from abrasion by a concrete encasing the rod-shaped element in the built-in state. Such environmental influences could otherwise lead to destruction or impairment of the strand.

In an embodiment, the elongation of the tube is greater than the elongation of the at least one strand, while at the same time the tensile strength of the at least one strand is greater than the tensile strength of the tube.

The production of tubes made of metal is known in principle. Essentially, seamless tubes, i.e. tubes without a weld seam in the longitudinal direction, and tubes welded in the longitudinal direction, so-called longitudinally welded tubes, are produced with the known methods.

In the case of the use of a seamless tube, the at least one strand is introduced into the opening of the provided tube axially. For tubes welded in the longitudinal direction, the step of introducing the strand at a different point is described in detail below.

Besides the weight reduction, the introduction of the at least one strand additionally has the advantage that through the introduced carbon fibres, in an embodiment, increased tensile strengths can be achieved compared with a solid rod-shaped element made of metal or a tube made of metal with the same outside diameter. Thus, through the introduction of the at least one strand an advantage can also be achieved over a comparable tube made of metal without a core.

In an embodiment, the cold forming of the tube with the at least one strand arranged therein also has a positive effect on the overall tensile strength of the rod-shaped element. Cold-forming methods are used, for example, to form a hollow metallic base body into a finished tube. Through the cold forming, the inside and outside diameter of a tube can be altered and dimensioned very precisely. Moreover, the cold forming is suitable for improving the surface properties of the tube.

In addition, the cold forming is accompanied by a work hardening, whereby the properties of the tubes produced in this way can be altered in a targeted manner. Through the work hardening it is possible to increase the material strength and thus also the tensile strength of the formed tube.

Within the meaning of the present disclosure, by a cold forming is meant a forming at a temperature which is lower than the recrystallization temperature of the metal.

With the cold forming and the work hardening accompanying it, not only can the properties of the tube be altered, but through the "shrink-fitting" of the tube onto the at least one strand and the positive-locking and/or friction-locking connection being formed thereby between the at least one strand and the tube the properties of the whole rod-shaped element can be improved.

In an embodiment, through the cold forming of the tube with the strand extending therein a tight positive locking between the tube and the at least one strand extending therein in the radial direction is provided, with the result that the at least one strand cannot move in relation to the tube in the radial direction.

In an embodiment, through the cold forming a friction locking between the tube and the at least one strand extending therein is provided, with the result that the friction force between the tube and the at least one strand prevents a relative movement between the tube and the at least one strand in the axial direction. Through the friction-locking connection a rod-shaped element is thus produced, the tensile strength of which, in an embodiment, is higher than the tensile strength of a solid rod-shaped element made of metal or of a tube made of metal with the same outside diameter.

In an embodiment of the present disclosure, the forming tool for the cold forming and the tube are therefore designed and arranged such that, after the cold forming, the tube and the at least one strand are connected to each other in a friction-locking manner.

In an embodiment of the present disclosure, after the cold forming the tube and the at least one strand are connected to each other in a friction-locking manner over the entire extent of the strand in the longitudinal direction of the tube.

It is understood that the tube can be deformed using the forming tool, depending on how it is set, such that the tube is pressed onto the at least one strand. The friction-locking connection is formed as a result of the pressing. Through the friction-locking connection of the at least one strand to the tube, it is guaranteed that the at least one strand can no longer shift in the axial direction in relation to the tube after the cold forming. In the radial direction, there is then an isotropic positive locking of the at least one strand.

If a plurality of threads with carbon fibres rub against each other or a plurality of carbon fibres rub against each other, this can lead to at least individual carbon fibres being weakened or destroyed. The properties of the strand formed of the threads are thereby permanently altered, e.g. its tensile strength is reduced. In an embodiment in which a friction locking between the tube and the at least one strand is brought about by the cold forming, the individual threads and/or individual carbon fibres therefore rub or affect one another to a lesser extent. In an embodiment, it can be achieved through the cold forming that the threads and/or, in an embodiment with several strands, the individual strands no longer shift in relation to each other or only do so to a lesser extent. The threads or the strands inside the tube are thus protected due to the cold forming.

In an embodiment, the step of cold forming by cold rolling or cold pilger rolling of the tube with the at least one strand extending therein in the longitudinal direction is effected in a cold pilger roiling mill. In this embodiment, it is understood that the forming tool is constituted by rollers or rolls.

Cold pilger rolling is a common forming method for adjusting the inside and outside diameter of a tube. Here, the tube is gripped by two calibrated rolls or rollers, which define the outside diameter of the tube, and rolled out, with the result that the rolls or rollers reduce the outside diameter of the incoming tube to the outside diameter of the rod-shaped element.

In a further embodiment, the cold forming is effected by cold drawing of the tube, together with the at least one strand extending therein, in the longitudinal direction through a drawing die. In this embodiment, the forming tool is constituted by the drawing die.

In the cold drawing of tubes, a distinction is made in principle between methods without an internal tool, so-called hollow drawing, and methods with an internal tool, i.e. in particular core drawing and bar drawing. If the cold forming is effected by cold drawing in an embodiment of the method according to the present disclosure, this is effected in principle without an internal tool inside the tube. However, the process of drawing the tube, together with the at least one strand extending therein, through the drawing die can be taken to mean, in an embodiment, drawing the tube onto the at least one strand. The at least one strand here is taken to mean the internal tool. In an embodiment, it is necessary to bring about a close contact of the tube and the at least one strand by corresponding dimensioning of the tube, the at least one strand and the drawing die, but without impairing or even damaging the strand by the action of force in the radial direction.

In an embodiment of the disclosure, the cold forming is effected by cold drawing of the tube, together with the at least one strand, in the longitudinal direction through a drawing die. In this embodiment, the drawing die constitutes the forming tool within the meaning of the present application. In an embodiment, an inside diameter of the drawing die and an outside diameter of the tube before the cold drawing are chosen such that the tube and the at least one strand are connected in a friction-locking manner after the cold drawing.

In an embodiment of the present disclosure, after the cold drawing the tube and the at least one strand are connected in a friction-locking manner over the entire extent of the strand in the longitudinal direction of the tube.

Carbon fibres within the meaning of the present disclosure are also referred to as CFs or graphite fibres. They are produced industrially arid are converted into carbon arranged in the manner of graphite by chemical reactions adapted to the raw material. Carbon fibres have high strength and rigidity with at the same time a low elongation at break in the axial direction.

A plurality of carbon fibres are combined to form a thread for the further processing. Such threads with carbon fibres are also referred to as multifilarnent threads or rovings. According to the present disclosure, by the term thread is meant a long, thin shape. Within the meaning of the present disclosure, in an embodiment a thread can also have fibres made of one or more different materials in addition to the carbon fibres. The thread acts as an intermediate product for the production of a strand within the meaning of the present disclosure.

In an embodiment of the present disclosure, the at least one strand is selected from a cord, a woven fabric, a mesh, a knitted fabric, a bundle, and a multiaxial fabric or any combination thereof.

In an embodiment, the at least one strand, which has a plurality of threads, additionally also contains one or more threads made of or with one or more materials other than carbon fibres.

In an embodiment, for example, the strand additionally has a thread with fibres made of a material with at least one property that is different from the properties of the carbon fibres. Such an additional property can have a positive effect on the characteristics of the rod-shaped element. In an embodiment, e.g., a hybrid strand with at least one additional thread with aramid fibres and/or glass fibres can be introduced in order, for example, to increase the linear elastic limit of the rod-shaped element thus produced.

in an embodiment of the present disclosure, the at least one strand contains at least 50% carbon fibres.

In an embodiment of the present disclosure, the at least one strand contains at least 90% carbon fibres.

in an embodiment of the present disclosure, the at least one strand consists entirely of carbon fibres.

In an embodiment of the present disclosure, after the step of cold forming the rod-shaped element is cut to a desired length.

In an embodiment of the present disclosure, the provision of the tube comprises the steps of:

providing a strip of a metal sheet, wherein the strip has a longitudinal direction and a transverse direction, bending the strip in the transverse direction, with the result that a tubular hollow body with the cross-sectional area of a cylinder is formed, welding closed the tubular hollow body with a longitudinal seam, wherein the longitudinal seam extends in the longitudinal direction, with the result that a longitudinally welded tube is formed, wherein the introduction of the at least one strand into the tube is effected by applying the strand to the strip before the welding closed.

In this embodiment, a longitudinally welded tube is used as a sheath for the at least one strand. The at least one strand is already introduced into the tube or applied to the strip of metal sheet which will form the tube before the tube is welded closed, i.e. before the actual completion of the tube. This embodiment therefore makes it possible to introduce the at least one strand into the tube easily. Unlike in the case of a seamless tube, it is not necessary to introduce the at least one strand into the tube axially.

In principle, it is unimportant when the strand is applied to the strip of metal sheet, i.e. is brought into engagement with the sheet, as long as it is applied before the welding closed.

In an embodiment of the present disclosure, however, the bending of the strip in the transverse direction comprises the steps of:

prebending the strip in the transverse direction, with the result that a trough-shaped hollow body with an opening extending in the longitudinal direction is formed, and finish bending the strip in the transverse direction, with the result that a tubular hollow body with the cross-sectional area of a cylinder is formed, wherein the introduction of the at least one strand into the tube is effected before the finish bending of the strip and through the opening into the trough-shaped hollow body.

Because the strip is prebent in the transverse direction and a trough-shaped hollow body is formed, during the introduction of the at least one strand the at least one strand is guided in the trough formed due to the prebending. When the at least one strand is introduced, it is thus guaranteed that the at least one strand cannot slip out of place in its introduced position on the strip.

In an embodiment of the present disclosure, the introduction of the at least one strand into the tube and the cold forming of the tube with the at least one strand are effected in one production line.

The term "in one production line", as used in the present disclosure, means that the introduction of the at least one strand into the tube and the cold forming are effected in the same production line. In an embodiment, the strand is introduced into the tube in one section of the tube, while another section of the same tube is already cold formed. Furthermore, in an embodiment the welding closed of the tube is also effected between the point at which the at least one strand is introduced and the point at which the tube is cold formed.

In an embodiment of the present disclosure, the welding closed and the cold forming are effected at a distance in a range of from 2 m to 4 m.

It has surprisingly become apparent that a spatial distance of from 2 m to 4 m between the point at which the step of welding closed is carried out and the point at which the step of cold forming is carried out has a positive effect on the properties of the rod-shaped element produced. If the welding closed and the cold forming are effected at a shorter or at a longer distance from each other, this can lead to problems during the cold forming of the tube with the at least one strand extending therein.

In an embodiment of the present disclosure, the tube consists of a stainless steel. Stainless steel has the advantage of a comparatively high tensile strength compared with other metals and a high resistance, for example, to environmental influences.

In an embodiment of the method according to the present disclosure, the outside diameter of the tube is larger before the cold forming, for example before the cold drawing, than after the cold forming.

In an embodiment of the present disclosure, the forming tool and an outside diameter of the tube before the cold forming are chosen such that a wall thickness of the tube is smaller before the cold forming than after the cold forming. In an embodiment of the present disclosure, an inside diameter of the drawing die and an outside diameter of the tube before the cold drawing are chosen such that a wall thickness of the tube is smaller before the cold drawing than after the cold drawing.

Through the cold forming, in particular through the cold drawing, material of the tube is displaced by the forming tool, for example the drawing die. The drawing die and the tube are expediently chosen such that the material of the tube is displaced concentrically inwards and thus the wall thickness of the tube is larger after the cold drawing than before the cold drawing.

According to a second aspect of the present disclosure, a rod-shaped element is proposed which is obtainable by any embodiment of the method according to the present disclosure.

A rod-shaped element which has a high tensile strength and a reduced self-weight compared with a solid rod-shaped element made of metal with the same tensile strength is produced by any of the above-described embodiments or any combination of the above-described embodiments of the method. The properties of the tube are altered and thus its tensile strength is increased by the cold forming, the work hardening of the tube accompanying it and the close positive locking associated with it between the tube and the at least one strand.

A rod-shaped element produced in such a way has at least one strand inside, consisting of a plurality of threads, wherein at least one of the threads has carbon fibres, and a tube made of metal encasing the strand, which encases the at least one strand.

In an embodiment of the present disclosure, the rod-shaped element is obtained with an embodiment of the method in which the cold forming results in a friction-locking connection between the at least one strand and the tube. In this embodiment, it is understood that the friction-locking connection between the tube and the at least one strand is provided during the cold forming by pressing the tube onto the at least one strand. The combination of the pressing and the work hardening thus results in a rod-shaped element the tensile strength of which exceeds both the tensile strength of a solid rod-shaped element made of metal with the same outside diameter and the tensile strength of a cold-formed tube with the same outside diameter.

According to a further aspect of the present disclosure, a rod-shaped element is proposed which has a tube made of a metal, wherein the tube has a longitudinal direction, and at least one strand extending in the longitudinal direction in the tube, wherein the at least one strand has a plurality of threads with carbon fibres and wherein the tube and the at least one strand are connected in a friction-locking manner, In an embodiment of the present disclosure, the tube and the at least one strand are connected to each other in a friction-locking manner over the entire extent of the strand in the longitudinal direction of the tube.

According to a further aspect, the present disclosure also relates to a device for producing a rod-shaped element, wherein the device has:

a feed apparatus for a tube made of metal, a feed apparatus for at least one strand with a plurality of threads, a forming apparatus, wherein the forming apparatus has a forming tool, wherein the feed apparatus for the tube and the feed apparatus for the at least one strand are designed and arranged such that, when the device is in operation, the strand extends in the tube upstream of the forming tool in the material flow direction, and that the tube made of metal with the at least one strand extending therein can be formed using the forming tool.

Where aspects of the disclosure are described with respect to a device for producing a rod-shaped element in the following, these also apply to the corresponding above-described method for producing a rod-shaped element, and vice versa, Where the method is carried out with a device according to this disclosure, the device has the corresponding apparatuses and equipment for this purpose. In particular, embodiments of the device are suitable for carrying out the above-described embodiments of the method.

In an embodiment of the present disclosure, the feed apparatuses on the one hand and the forming apparatus on the other are provided in separate production lines spatially separated from each other. In a further embodiment, the feed apparatuses for the tube and the at least one strand as well as the forming apparatus are provided in a single production line, wherein this production line is the claimed device.

In an embodiment of the present disclosure, the forming apparatus is an apparatus for cold forming a tube made of metal.

In an embodiment of the invention, the forming tool is a tool for carrying out a forming of the tube according to DIN 8580.

In an embodiment of the present disclosure, the forming apparatus is a draw bench, wherein the draw bench has a drawing die as forming tool and wherein, when the device is in operation, the strand extends in the tube upstream of the drawing die in the material flow direction, with the result that the tube made of metal and the at least one strand can be drawn through the drawing die together.

In an embodiment of the present disclosure, the draw bench is a continuous draw bench.

In an embodiment of the present disclosure, the feed apparatus for the tube has:

a feed apparatus for a strip of a metal sheet, wherein the strip has a longitudinal direction and a transverse direction, a bending apparatus for bending the strip in the transverse direction, with the result that a tubular hollow body with the cross-sectional area of a cylinder is formed, and a welding apparatus for welding closed the tubular hollow body with a longitudinal seam, wherein the longitudinal seam extends in the longitudinal direction, with the result that a longitudinally welded tube is formed, and wherein the feed apparatus for the tube and the feed apparatus for the at least one strand are designed and arranged such that the strand can be applied to the strip of the metal sheet upstream of the welding apparatus in the material flow direction.

In an embodiment of the present disclosure, the bending apparatus for bending the strip of the metal sheet in the transverse direction has a prebending apparatus and a finish-bending apparatus, wherein the prebending apparatus is set up and arranged such that the prebending apparatus prebends the strip in the transverse direction to give a trough-shaped hollow body with an opening extending in the longitudinal direction, and wherein the finish-bending apparatus is set up and arranged such that the finish-bending apparatus finish bends the strip in the transverse direction to give a tubular hollow body with the cross-sectional area of a cylinder and wherein the feed apparatus for the at least one strand is designed and arranged such that the feed apparatus applies the at least one strand to the trough-shaped hollow body made of metal sheet between the prebending apparatus and the finish-bending apparatus in the material flow direction.

In an embodiment of the present disclosure, the device has a control apparatus, wherein the control apparatus is operatively connected to the feed apparatus for the strip, to the feed apparatus for the at least one strand and to the welding apparatus such that the control apparatus, when the device is in operation, controls a feeding speed of the feed apparatus for the strip, a feeding speed of the feed apparatus for the at least one strand and a welding speed of the welding apparatus.

In an embodiment, the control apparatus is used to control the feeding speeds and welding speed such that they affect the friction-locking connection between the tube and the at least one strand. Depending on the control of the corresponding speeds, the friction locking between the tube and the at least one strand is set in an embodiment, with the result that, for example, the tube and the at least one strand are connected to each other in a friction-locking manner uniformly over the entire extent of the strand in the longitudinal direction of the tube.

In an embodiment, the control apparatus additionally controls the processing speed of the forming apparatus.

In an embodiment, the control of the processing speed is also capable of affecting the friction-locking connection between the tube and the at least one strand.

In an embodiment, it is understood that the control apparatus comprises a computer or a processor as well as a computer program running on it.

In an embodiment of the present disclosure, the device is designed such that there is a distance of from 2 m to 4 m between the welding apparatus and the forming tool of the forming apparatus, for example the drawing die of the draw bench. In such an embodiment, the welding apparatus and the forming tool are constituent parts of a single production line.

BRIEF DESCRIPTION OF THE FIGURES

Further advantages, features and possible applications of the present disclosure will become clear with the aid of the following description of an embodiment and the associated figures. The above general description and the following detailed description of an implementation of the present disclosure can be better understood if they are considered in conjunction with the attached drawings. The implementations shown are not limited to the designs described in detail. In the figures similar elements are denoted by identical reference numbers.

DETAILED DESCRIPTION

Figure 1:
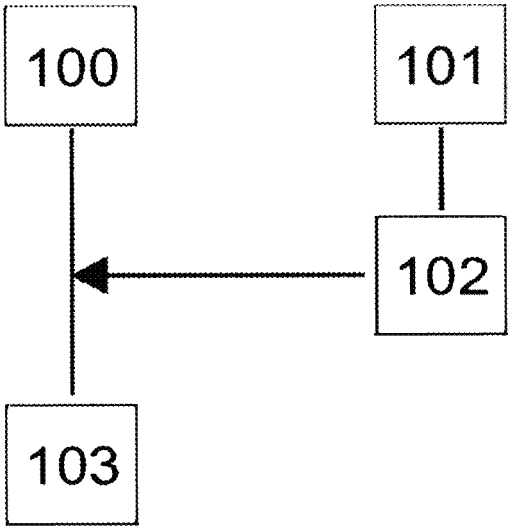
FIG. 1 is a flow diagram of an implementation of the method according to the present disclosure for producing a rod-shaped element according to an embodiment of the present disclosure.

FIG. 1 is a flow diagram of an implementation of the method for producing a rod-shaped element according to the present disclosure. In a first step 100 a stainless steel tube is provided, wherein the stainless steel tube has a longitudinal direction. In a further step 101, at the same time as the first step 100, a mesh is provided which is formed of a plurality of threads made of carbon fibres. In the implementation shown, 100% of the thus-formed strand consists of carbon fibres.

In the implementation shown, the stainless steel tube is a seamless tube, i.e. without a weld seam in the longitudinal direction, and the strand is pushed into the stainless steel tube axially in a further step 102, with the result that the strand extends in the longitudinal direction in the tube. After the introduction 102 of the strand into the stainless steel tube, the tube with the strand extending in the longitudinal direction in the tube is cold formed using a forming tool in step 103. In the implementation shown, the cold forming is carried out by cold rolling in a cold pilger rolling mill. After the cold pilger rolling 103, the stainless steel tube and the strand are connected to each other in a friction-locking manner over the entire extent of the strand in the longitudinal direction of the tube.

Figure 2:
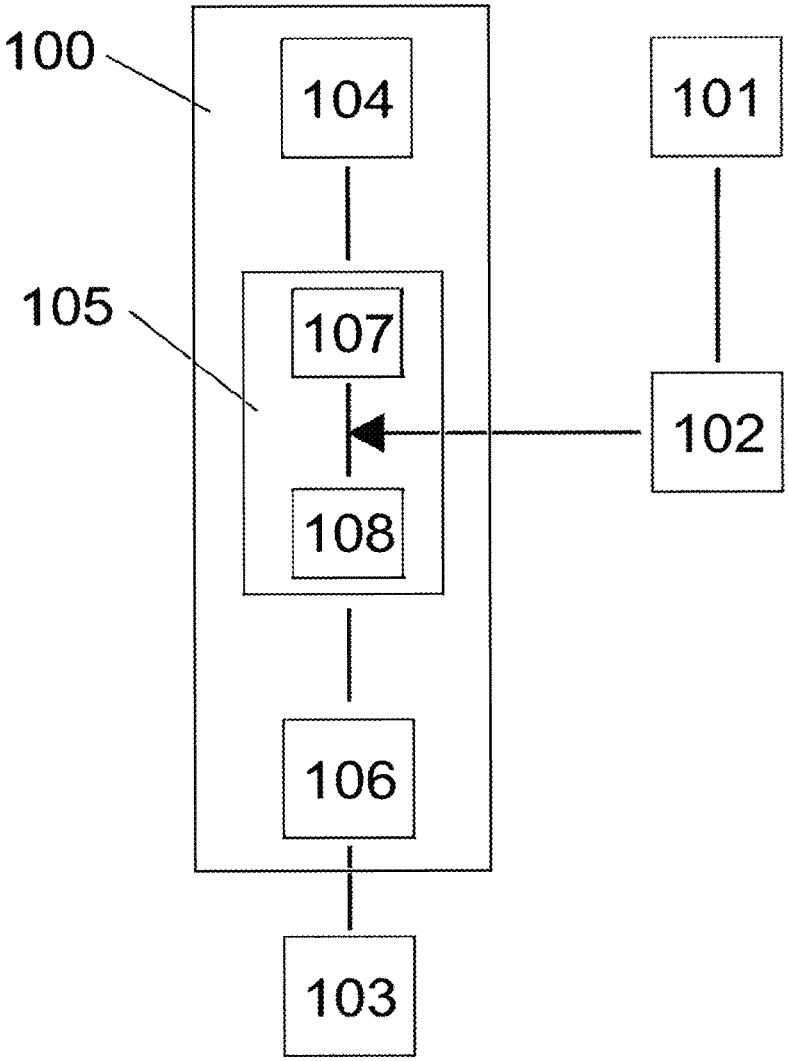
FIG. 2 is a flow diagram of a further implementation of the method according to the present disclosure for producing a rod-shaped element according to another implementation of the present disclosure.

FIG. 2 shows a flow diagram of a further implementation of the method for producing a rod-shaped element. Here, the individual steps of the method according to this implementation take place in one production line, wherein a strip of stainless steel sheet and the strand are fed to the production line as starting materials.

In the case of the method described with reference to FIG. 2, the step of providing 100 the stainless steel tube thus also comprises the actual manufacture of the stainless steel tube. For this, the provision 100 of the tube first comprises, in step 104, providing a strip of a stainless steel sheet. The strip has a longitudinal direction and a transverse direction. In step 105, the strip is bent in the transverse direction to give the tube.

To bend the tube, the strip is first prebent in step 107, with the result that a trough-shaped hollow body with an opening extending in the longitudinal direction is formed. At the same time, in step 101, a strand with a plurality of threads with carbon fibres is provided. In the implementation shown, the strand consists of a mesh containing 60% carbon fibres. After the prebending 107 of the stainless steel sheet, the strand is introduced into the trough-shaped hollow body in the longitudinal direction in step 102. Through the trough shape, the strand is guided on the stainless steel sheet, with the result that the strand cannot slide off the stainless steel sheet. Once the strand has been introduced into the trough, the stainless steel sheet is finish bent in the transverse direction in step 108, with the result that a tubular hollow body with the cross-sectional area of a cylinder is formed, which wraps around the strand. In step 106, the tubular hollow body, which consists of the stainless steel sheet, is welded closed with a longitudinal seam to form a longitudinally welded stainless steel tube. This ends step 100 of providing the tube.

After being welded closed 106, the tube is cold formed in step 103. In the implementation of the method according to FIG. 2, the cold forming is effected by cold drawing. For this, the tube is drawn, together with the strand, in the longitudinal direction through a drawing die as forming tool. After the cold drawing 103, the stainless steel tube and the strand are connected to each other in a friction-locking manner over the entire extent of the strand in the longitudinal direction of the tube.

Figure 3:
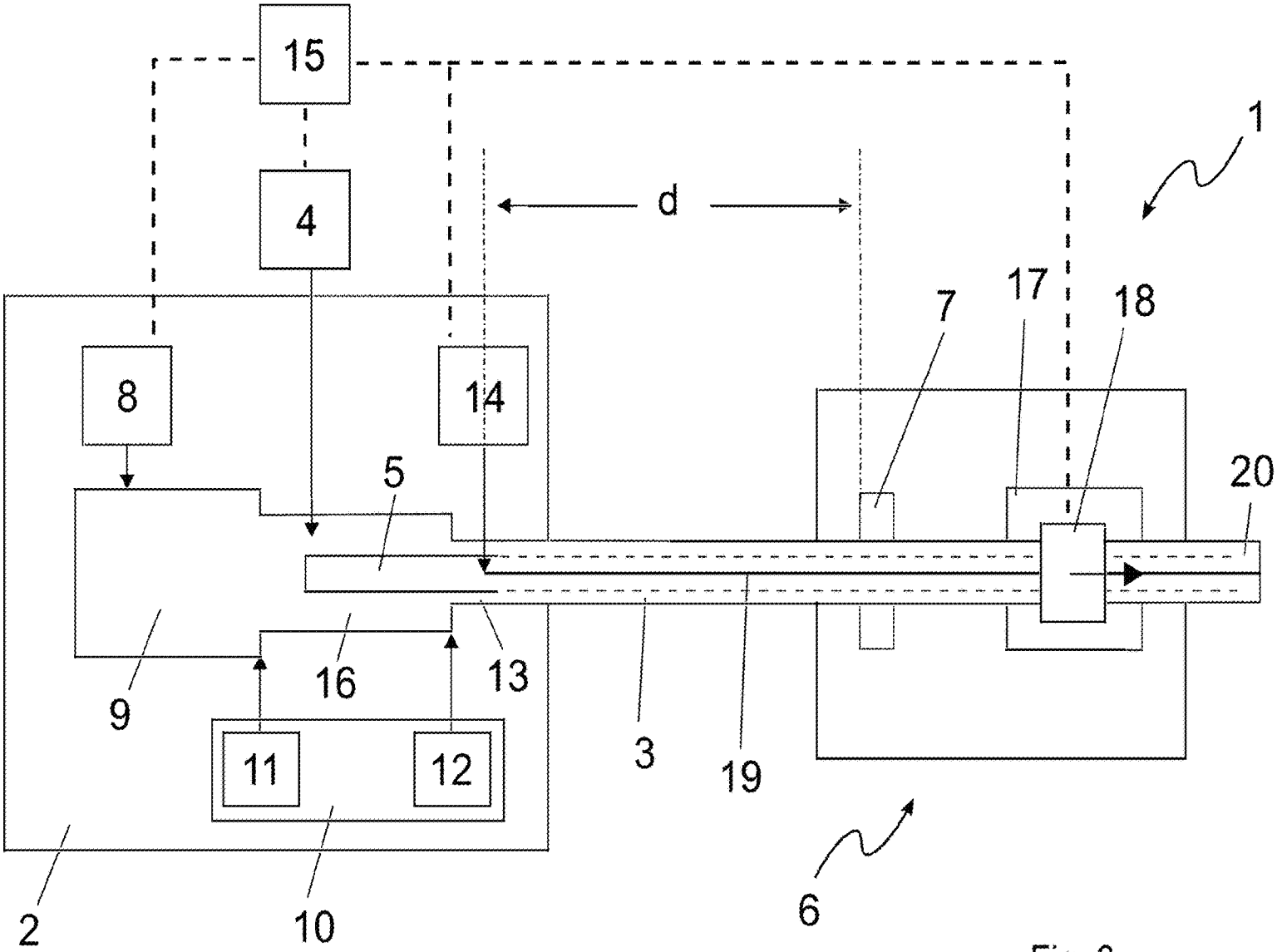
FIG. 3 is a schematic top view of an implementation of the device for producing a rod-shaped element for carrying out the method from FIG. 2.

FIG. 3 shows a schematic top view of a device 1 for producing a rod-shaped element 20 in an implementation of the present disclosure. The device 1 for producing the rod-shaped element 20 carries out the method for producing the rod-shaped element 20, as has been described above with reference to FIG. 2.

Figure 4:
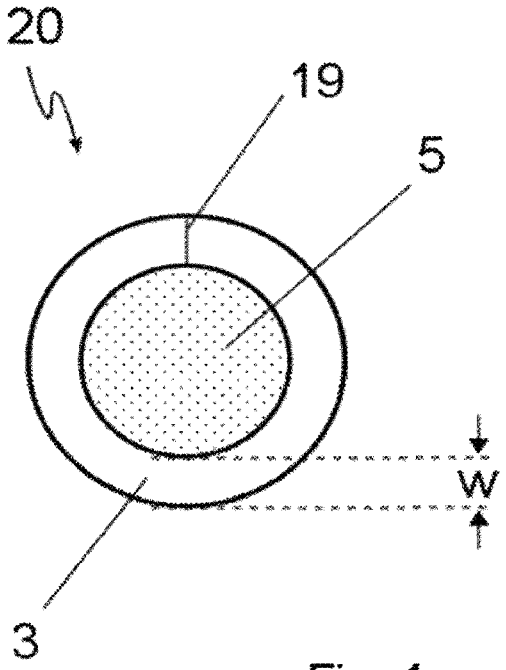
FIG. 4 is a schematic cross-sectional view of an implementation of the rod-shaped element, which it has been obtained with the method from FIG. 2 or the device from FIG. 3.

In addition to this, FIG. 4 shows a cross-sectional view in a section plane perpendicular to the longitudinal direction of the rod-shaped element 20, which has been produced with the device 1 from FIG. 3.

The device 1 has a feed apparatus 2 for the stainless steel tube 3, wherein the feed apparatus 2 is made up of a plurality of apparatuses.

The feed apparatus 2 for the stainless steel tube 3 first of all comprises a feed apparatus 8 for the strip 9 of stainless steel sheet. The strip 9 has a longitudinal direction and a transverse direction, wherein the extension is much greater in the longitudinal direction than in the transverse direction.

In addition, the feed apparatus 2 for the stainless steel tube 3 has a bending apparatus 10 for bending the strip 9. The bending apparatus 10 consists of a prebending apparatus 11 and a finish-bending apparatus 12. The strip 9 is first prebent with the prebending apparatus 11, with the result that the trough-shaped hollow body 16 is formed. The strand 5 is introduced into this trough-shaped hollow body 16 into the trough-shaped hollow body with a feed apparatus 4. Through the trough of the trough-shaped hollow body 16, the strand 5 is placed and guided centrally on the strip 9, with the result that the strand 5 cannot slide off the strip 9.

After the strand 5 has been applied to the sheet metal strip 16, the trough-shaped hollow body 16 is bent with the finish-bending apparatus 12 to give a tubular hollow body 13 with a circular cross section, wherein the strand 5 extends inside the tubular hollow body 13 in the longitudinal direction. The tubular hollow body 13 is then welded with a longitudinal seam 19 with a welding apparatus 14, which is likewise part of the feed apparatus 2 for the tube 3, with the result that the longitudinal seam 19 extends in the longitudinal direction and a longitudinally welded stainless steel tube 3 is formed.

The drawing die 7 of a draw bench 6 is provided at a distance d of 3 m downstream of the welding apparatus 14. To carry out the drawing process, the draw bench 6 has, in addition to the drawing die 7, a motor-driven carriage 17 with a clamping cylinder 18 installed on it for gripping the tube 3 downstream of the drawing die 7.

By drawing the tube 3, together with the strand 5 arranged therein, through the drawing die 7 the rod-shaped element 20 is formed. The inside diameter of the drawing die 7 and the outside diameter of the stainless steel tube 3 before the drawing are chosen such that, after the cold drawing, the stainless steel tube has a wall thickness w as represented in FIG. 4. Whereas the outside diameter of the tube is reduced after the cold drawing, the wall thickness w is larger after the cold drawing than before the cold drawing. Through the cold drawing, the tube 3 and the strand 5 are connected to each other in a friction-locking manner over the entire extent of the strand 5 in the longitudinal direction in the tube 3 downstream of the drawing die 7. The strand 5 cannot slip out of place inside the tube 3 in the axial direction. A rod-shaped element 20 with a tensile strength exceeding the tensile strength of the cold-drawn tube has been formed.

A central control apparatus 15 is electrically connected to the feed apparatus 8 for the sheet metal strip 9, to the feed apparatus 4 for the strand 5. to the welding apparatus 14 and to the draw bench 6. During operation of the line 1, the control apparatus 15 controls the feeding speeds of the strip 9, of the strand 5, as well as the welding speed of the welding apparatus 14 and the drawing speed of the draw bench 6. By controlling the above-named speeds the tube 3 and the strand 5 are connected to each other in a friction-locking manner uniformly over the entire extent of the strand 5 in the longitudinal direction in the tube 3 downstream of the drawing die 7.

For the purpose of original disclosure, it is pointed out that all features, as revealed to a person skilled in the art from the present description and the drawing, as well as the claims, even if they have been described specifically only in connection with particular further features, can be combined both individually and in any desired combinations with others of the features or groups of features disclosed here, unless this has been explicitly ruled out or technical circumstances make such combinations impossible or meaningless. Merely for the sake of brevity and readability of the description, the comprehensive, explicit representation of all conceivable combinations of features is dispensed with here.

While the disclosure has been represented and described in detail in the drawings and the preceding description, this representation and description is effected merely by way of example and is not intended to limit the scope of protection, as defined by the claims. The disclosure is not limited to the disclosed embodiments.

Modifications of the disclosed embodiments are obvious to a person skilled in the art from the drawings, the description and the attached claims. In the claims the word "have" does not rule out other elements or steps, and the indefinite article "a" or "an" does not rule out a plurality. The mere fact that particular features are claimed in different claims does not rule out combining them. Reference numbers in the claims are not intended to limit the scope of protection.

LIST OF REFERENCE NUMBERS

1 device for producing a rod-shaped element
2 feed apparatus for a stainless steel tube
3 stainless steel tube
4 feed apparatus for a strand
5 strand
6 draw bench
7 drawing die
8 feed apparatus for a strip
9 strip
10 bending apparatus
11 prebending apparatus
12 finish-bending apparatus
13 tubular hollow body
14 welding apparatus
15 control apparatus
16 trough-shaped hollow body
17 carriage
18 clamping cylinder
19 longitudinal seam
20 rod-shaped element
d distance
w wall thickness
100 providing a tube
101 providing a strand
102 introducing a strand
103 cold forming
104 providing a strip
105 bending a strip
106 welding closed
107 prebending a strip
108 finish bending a strip

The invention claimed is:

1. A method for producing a rod-shaped element, wherein the method has the steps of:

providing a tube made of a metal, wherein the tube has an outside diameter and a longitudinal direction;

providing at least one strand with a plurality of threads, wherein at least one of the threads has carbon fibres;

introducing the at least one strand into the tube, with the result that the at least one strand extends in the longitudinal direction in the tube; and cold forming the tube with the at least one strand introduced therein using a forming tool, with the result that the outside diameter of the tube before the cold forming is larger than the outside diameter of the tube after the cold forming, wherein providing the tube comprises the steps of:

providing a strip of a metal sheet, wherein the strip has a longitudinal direction and a transverse direction, bending the strip in the transverse direction, with the result that a tubular hollow body with a cross-sectional area of a cylinder is formed, and welding closed the tubular hollow body with a longitudinal seam, wherein the longitudinal seam extends in the longitudinal direction of the strip, with the result that a longitudinally welded tube is formed, wherein introducing the at least one strand into the tube includes applying the strand to the strip prior to welding, wherein cold forming the tube is performed by cold drawing of the tube, together with the at least one strand, in the longitudinal direction of the tube through a drawing die, wherein an inside diameter of the drawing die and the outside diameter of the tube before the cold drawing are chosen such that the tube and the at least one strand are connected in a friction-locking manner after the cold drawing, and wherein the inside diameter of the drawing die and the outside diameter of the tube before the cold drawing are chosen such that a wall thickness of the tube is smaller before the cold drawing than after the cold drawing.

2. The method according to claim 1, wherein bending of the strip in the transverse direction comprises the steps of:

prebending the strip in the transverse direction, with the result that a trough-shaped hollow body with an opening extending in the longitudinal direction of the strip is formed, and finish bending the strip in the transverse direction, with the result that the tubular hollow body with the cross-sectional area of the cylinder is formed, and wherein introduction of the at least one strand into the tube occurs prior to the finish bending of the strip and through the opening into the trough-shaped hollow body.

3. The method according to claim 1, wherein introduction of the at least one strand into the tube and cold forming of the tube with the at least one strand are performed in one production line.

4. The method according to claim 1, wherein welding closed the tubular hollow body and cold forming the tube are performed at a distance in a range of from 2 m to 4 m.

5. The method according to claim 1, wherein the tube consists of a stainless steel.

6. The method according to claim 1, wherein the at least one strand is selected from a cord, a woven fabric, a mesh, a knitted fabric and a multiaxial fabric or any combination thereof.

7. The method according to claim 1, wherein the at least one strand contains at least 50% carbon fibres.

8. The method according to claim 1, wherein the at least one strand forms a core of the rod-shaped element.

9. The method according to claim 1, wherein the tube extends around the at least one strand as a sheath.

10. The method according to claim 1, wherein bending of the strip in the transverse direction comprises the steps of:

prebending the strip in the transverse direction in a prebending apparatus, with the result that a trough-shaped hollow body with an opening extending in the longitudinal direction of the strip is formed, and finish bending the strip in the transverse direction in a finish-bending apparatus, with the result that the tubular hollow body with the cross-sectional area of the cylinder is formed, and wherein introduction of the at least one strand into the tube occurs after the prebending of the strip and prior to the finish bending of the strip and through the opening into the trough-shaped hollow body.

11. A method for producing a rod-shaped element, wherein the method has the steps of:

providing a tube made of a metal, wherein the tube has an outside diameter and a longitudinal direction;

providing at least one strand with a plurality of threads, wherein at least one of the threads has carbon fibres;

introducing the at least one strand into the tube, with the result that the at least one strand extends in the longitudinal direction in the tube; and cold forming the tube with the at least one strand introduced therein using a forming tool, with the result that the outside diameter of the tube before the cold forming is larger than the outside diameter of the tube after the cold forming, wherein cold forming the tube is performed by cold drawing of the tube, together with the at least one strand, in the longitudinal direction of the tube through a drawing die, wherein an inside diameter of the drawing die and the outside diameter of the tube before the cold drawing are chosen such that the tube and the at least one strand are connected in a friction-locking manner after the cold drawing, and wherein the inside diameter of the drawing die and the outside diameter of the tube before the cold drawing are chosen such that a wall thickness of the tube is smaller before the cold drawing than after the cold drawing.

12. The method according to claim 11, wherein providing the tube comprises the steps of:

providing a strip of metal sheet, wherein the strip has a longitudinal direction and a transverse direction, and bending the strip in the transverse direction, wherein bending of the strip in the transverse direction comprises the steps of:

prebending the strip in the transverse direction, with the result that a trough-shaped hollow body with an opening extending in the longitudinal direction of the strip is formed, and finish bending the strip in the transverse direction, with the result that a tubular hollow body with a cross-sectional area of a cylinder is formed, and wherein introduction of the at least one strand into the tube occurs prior to the finish bending of the strip and through the opening into the trough-shaped hollow body.

13. The method according to claim 11, wherein introduction of the at least one strand into the tube and cold forming of the tube with the at least one strand are performed in one production line.

14. The method according to claim 11, wherein the tube consists of a stainless steel.

15. The method according to claim 11, wherein the at least one strand is selected from a cord, a woven fabric, a mesh, a knitted fabric and a multiaxial fabric or any combination thereof.

16. The method according to claim 11, wherein the at least one strand contains at least 50% carbon fibres.

17. The method according to claim 11, wherein the at least one strand forms a core of the rod-shaped element.

18. The method according to claim 11, wherein the tube extends around the at least one strand as a sheath.

* * * * *